US006296537B1

(12) United States Patent
Toyama et al.

(10) Patent No.: US 6,296,537 B1
(45) Date of Patent: Oct. 2, 2001

(54) OUTBOARD MOTOR

(75) Inventors: Takeshi Toyama; Satoshi Isobe, both of Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/580,869

(22) Filed: May 30, 2000

(30) Foreign Application Priority Data

May 27, 1999 (JP) ..... 11-148494

(51) Int. Cl.[7] ..... B63H 21/10; B63H 21/32
(52) U.S. Cl. ..... 440/89; 440/88
(58) Field of Search ..... 440/88, 89

(56) References Cited

U.S. PATENT DOCUMENTS 5,916,135 * 6/1999 Yoshida et al. ..... 60/302
5,937,801 * 8/1999 Davis ..... 123/41.33
5,984,742 * 11/1999 Kimura et al. ..... 440/77
6,012,956 * 1/2000 Mishima et al. ..... 440/88
6,053,784 * 4/2000 Takahashi ..... 440/88

* cited by examiner

*Primary Examiner*—S. Joseph Morano
*Assistant Examiner*—Andrew Wright
(74) *Attorney, Agent, or Firm*—Oblon, Spivak, McClelland, Maier & Neustadt, P.C.

(57) ABSTRACT

An outboard motor generally includes an engine holder, an engine disposed above the engine holder in a state of the outboard motor being mounted to a hull, an oil pan disposed below the engine holder, and a drive shaft housing disposed below the oil pan. Exhaust passages are formed in the engine holder and the oil pan and adapted to exhaust an exhaust gas from the engine into the drive shaft housing, one exhaust passage formed to the oil pan has a downstream side end opening, and an exhaust tube is provided for a bottom surface portion of the oil pan so as to align with the downstream side end opening of the one exhaust passage. The exhaust tube having a downstream side outlet positioned, in a plan view, at a substantially central portion of the drive shaft housing.

6 Claims, 6 Drawing Sheets

OUTBOARD MOTOR

BACKGROUND OF THE INVENTION

The present invention relates to an outboard motor particularly provided with an improved exhaust structure.

Engines of outboard motors include an engine, generally of water-cooling type, having a cylinder block in which a plurality of cylinders are arranged in a vertical direction. In a cylinder head connected to the cylinder block, intake ports and exhaust ports are formed for the respective cylinders. Exhaust gas discharged from the exhaust ports is collected into a common exhaust passage and then discharged from the outboard motor.

Since the exhaust passage is heated to a very high temperature by the exhaust gas, a cooling water passage is formed around the exhaust passage to cool the exhaust passage by means of cooling water. Such a cooling water passage is provided for members of the engine, such as cylinder block, an engine holder and an oil pan.

However, in a conventional structure of the outboard motor, in some cases, the exhaust gas is not sufficiently cooled even by the location of a cooling water passage to a member (or members) such as cylinder block, engine holder and oil pan through which an exhaust passage passes. When the exhaust gas having a high temperature from the engine is discharged from the discharge passage into the drive shaft housing, an outer wall of the drive shaft housing is heated by the exhaust gas and a temperature thereof is increased and, hence, calcium contained in a sea water, for example, pumped up as cooling water may adhere to the outer wall of the drive shaft housing, thus being inconvenient.

SUMMARY OF THE INVENTION

An object of the present invention is to substantially eliminate defect or drawback encountered in the prior art mentioned above and to provide an outboard motor having an improved exhaust structure capable of improving cooling efficiency of an exhaust gas.

This and other objects can be achieved according to the present invention by providing an outboard motor comprising:

- an engine holder;
- an engine disposed above the engine holder in a state of the outboard motor being mounted to a hull;
- an oil pan disposed below the engine holder;
- a drive shaft housing disposed below the oil pan;
- an exhaust passage means formed in the engine, the engine holder and the oil pan and adapted to exhaust an exhaust gas from the engine into the drive shaft housing, the exhaust passage means having a downstream side end opening; and
- an exhaust tube provided for a bottom surface portion of the oil pan so as to align with the downstream side end opening of the exhaust passage means, the exhaust tube having a downstream side outlet positioned, in a plan view, at a substantially central portion of the drive shaft housing.

In a preferred embodiment, the exhaust passage means comprises a plurality of exhaust passages including a passage formed to the oil pan which has the downstream side end opening aligned with the exhaust tube.

The outboard motor may further comprises a water pump disposed to a bottom portion of the drive shaft housing for pumping up a cooling water and a cooling water passage means formed in the engine holder and the oil pan, and the cooling water pumped up by the water pump is guided to the engine through the cooling water passage means and the cooling water passage means includes a cooling water passage formed in the oil pan, a relief valve is provided for the cooling water passage and the exhaust tube is disposed in a vicinity of the relief valve. The cooling water passage means comprises a plurality of cooling water passages including a horizontal passage formed to a bottom portion of the oil pan for which the relief valve is provided. The outboard motor may further comprises a cooling water discharge passage means formed in the engine holder and the oil pan for discharging the cooling water after cooling the engine inside the drive shaft housing and a return water guide formed integrally with the exhaust tube, the cooling water discharge passage means having a downstream side end opening with which the return water guide is aligned. The cooling water discharge passage means comprises a plurality of cooling water discharge passages including a passage formed to the oil pan which has the downstream side end opening with which the return water guide is aligned.

The return water guide has a box-shaped cross section having an opened side portion which is disposed so as to face a vertical wall section formed in the drive shaft housing. The return water guide is disposed on one side of the exhaust tube and the relief valve is disposed on another one side of the exhaust tube.

According to the structures and characters of the present invention mentioned above, the exhaust gas is guided to substantially the central portion of the drive shaft housing, in a plan view, by means of the exhaust tube provided for the bottom surface of the oil pan. Therefore, the exhaust gas having a high temperature does not directly collide with the outer wall section of the drive shaft housing, and hence, the temperature increasing of the outer wall section can be prevented and the adhesion of calcium, which may be contained in sea water, for example, to the outer wall section of the drive shaft housing can be also prevented.

Incidentally, the location of the relief valve to the horizontal cooling water passage and the location of the exhaust tube in the vicinity of the relief valve can allow the exhaust gas therein to be effectively cooled.

According to the present invention, the return water, which is discharged in the exhaust chamber, is guided to substantially the central portion of the drive shaft housing, in a plan view, by means of the return water guide integrally formed with the exhaust tube provided for the bottom surface of the oil pan. Therefore, the return water having a high temperature does not directly collide with the outer wall section of the drive shaft housing, and accordingly, the temperature increasing of the outer wall section can be prevented and the adhesion of calcium, which may be contained in sea water, for example, to the outer wall section of the drive shaft housing can be also prevented.

Still furthermore, the return water guide provided for the bottom surface of the oil pan to provide the box-shaped section is arranged so as to face the vertical wall section formed in the drive shaft housing, thus providing a closed sectional structure. Accordingly, the cross sectional area, i.e. effective passage area, of the cooling water discharge passages, through which the cooling water passes can be ensured to be large.

Still furthermore, since the return water guide formed integrally with the exhaust tube is formed so as to have a box-shape section, it is not necessary to use a core in the casting process, thus being advantageous in economical point and structural point and improving the yielding.

According to the present invention, furthermore, since the return water guide and the exhaust tube are formed integrally, the return water having a temperature lower than that of the exhaust gas can be utilized as the cooling water for the exhaust tube. Moreover, the return water guide is disposed on one side of the exhaust tube so as to oppose to the water pressure valve which is disposed on the other side of the exhaust tube, so that the portion of the exhaust tube which has not been cooled by the cooling water discharged from the water pressure valve can be cooled by the return water, thus improving the cooling efficiency of the exhaust tube and the exhaust gas.

The nature and further characteristic features of the present invention will be made more clear from the following descriptions made with reference to the accompanying drawings.

DESCRIPTION OF THE PREFERRED EMBODIMENT

Preferred embodiments of the present invention will be described hereunder with reference to the accompanying drawings.

Figure 1:
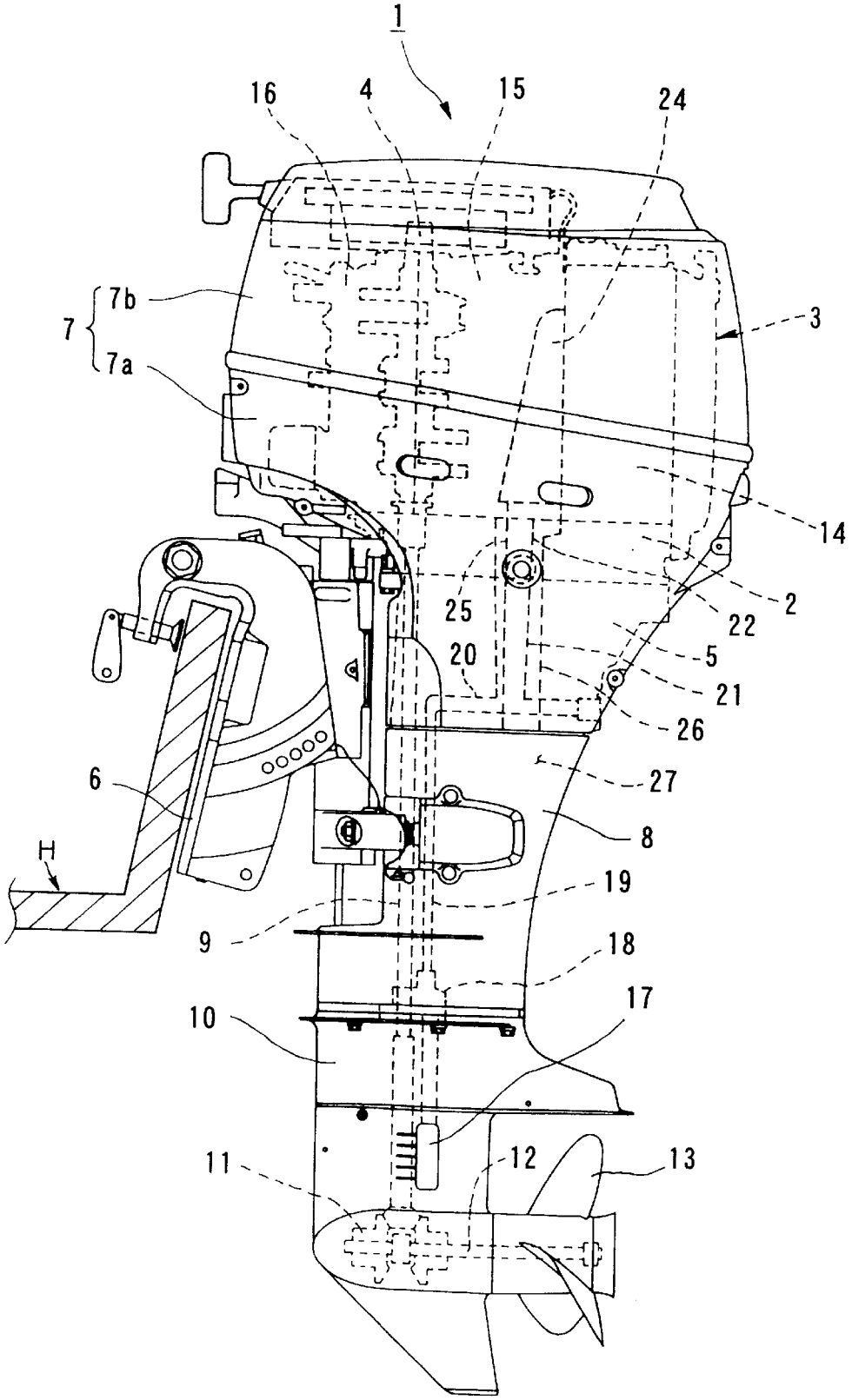
FIG. 1 is a side view of an outboard motor to which the present invention is applied in a state of the outboard motor being mounted to a hull.

As shown in FIG. 1, the outboard motor 1 is in a state mounted to a hull H and includes an engine holder 2 and an engine 3 disposed above the engine holder 2. The engine 3 is a vertical type engine in which a crankshaft 4 is disposed substantially vertically.

An oil pan 5 is disposed below the engine holder 2, a bracket 6 is mounted to the engine holder 2 for example, and the outboard motor 1 is mounted to a transom of a hull H through the bracket 6. Peripheries of the engine 3, the engine holder 2 and the oil pan 5 of the outboard motor 1 are covered with an engine cover 7. The engine cover 7 comprises a lower cover section 7*a* covering the lower portion of the engine 3, the engine holder 2 and the oil pan 5 and an upper cover section 7*b* covering the upper portion of the engine 3.

A drive shaft housing 8 is disposed at a lower portion of the oil pan 5. A drive shaft 9 is disposed substantially vertically in the engine holder 2, the oil pan 5 and the drive shaft housing 8, and an upper end of the drive shaft 9 is connected to a lower end of the crankshaft 4. The drive shaft 9 extends downward in the drive shaft housing 8 for driving a propeller 13 through a bevel gear 11 and a propeller shaft 12 housed in a gear case 10 provided in a lower portion of the drive shaft housing 8.

Figure 2:
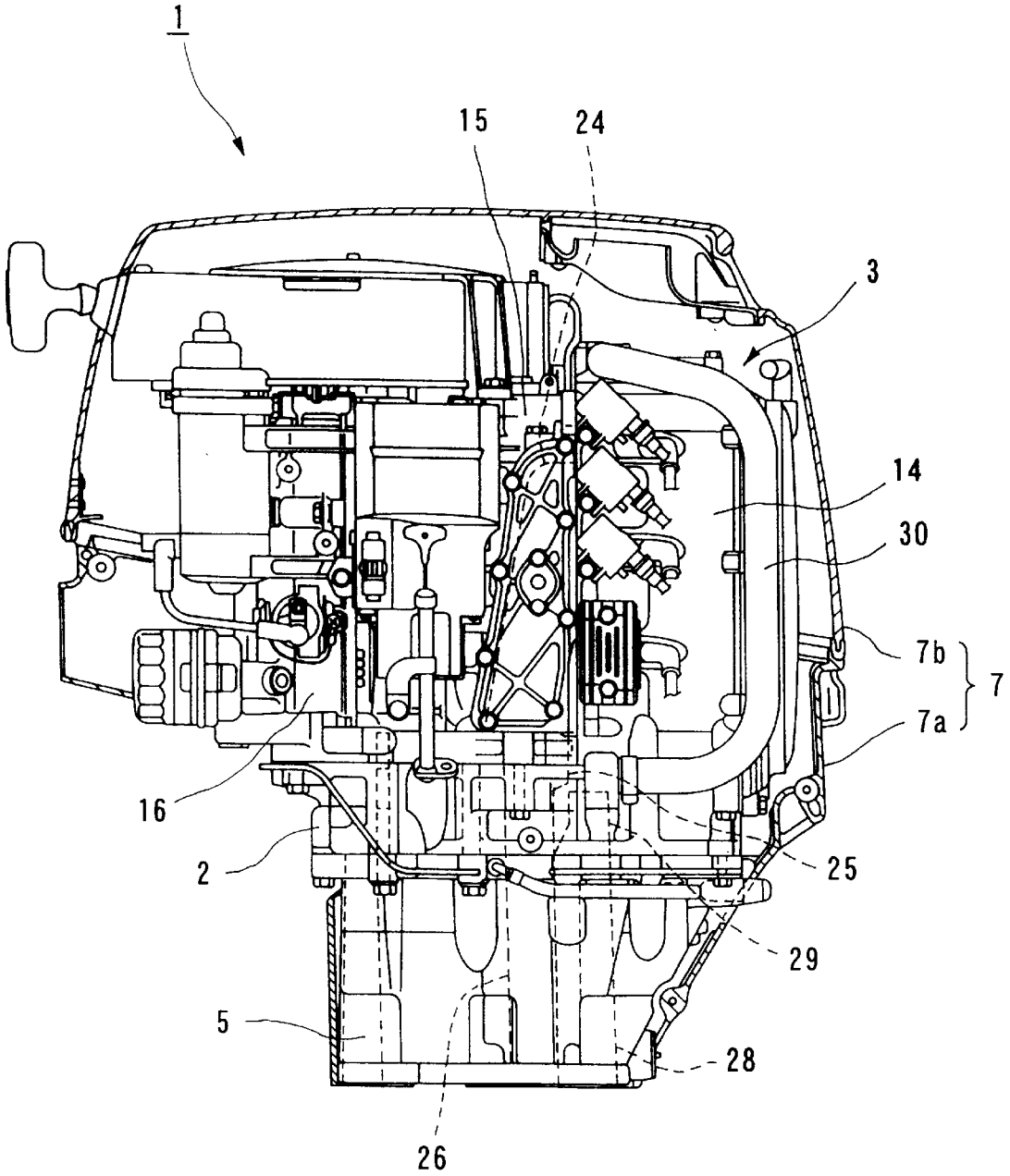
FIG. 2 is an enlarged side view of an engine of the outboard motor of FIG. 1.

With reference to FIGS. 1 and 2, the engine 3 mounted to the outboard motor 1 is a water-cooled four-stroke-cycle three-cylinder engine, which comprises, in combination, a cylinder head 14, a cylinder block 15, a crankcase 16 and the like. The cylinder block 15 is disposed rearward (right side) of the crankcase 16 disposed at the leftmost position in FIG. 1. The cylinder head 14 is disposed rearward the cylinder block 15.

As mentioned above, this engine 3 is a water-cooled type and utilizes a cooling water which is sea water, lake water, river water or like taken into the engine through a water intake port 17 to cool the engine 3. The cooling water is pumped up through the water intake port 17 by means of water pump 18 disposed on the bottom portion of the drive shaft housing 8 and driven by the drive shaft 9. The cooling water is then guided, through water-feed pipe 19 extending upward in the drive shaft housing 8, into a plurality of cooling water passages 20, 21 and 22 formed in the oil pan 5 and the engine holder 2, through which the cooling water is further guided into the engine 3.

Figure 3:
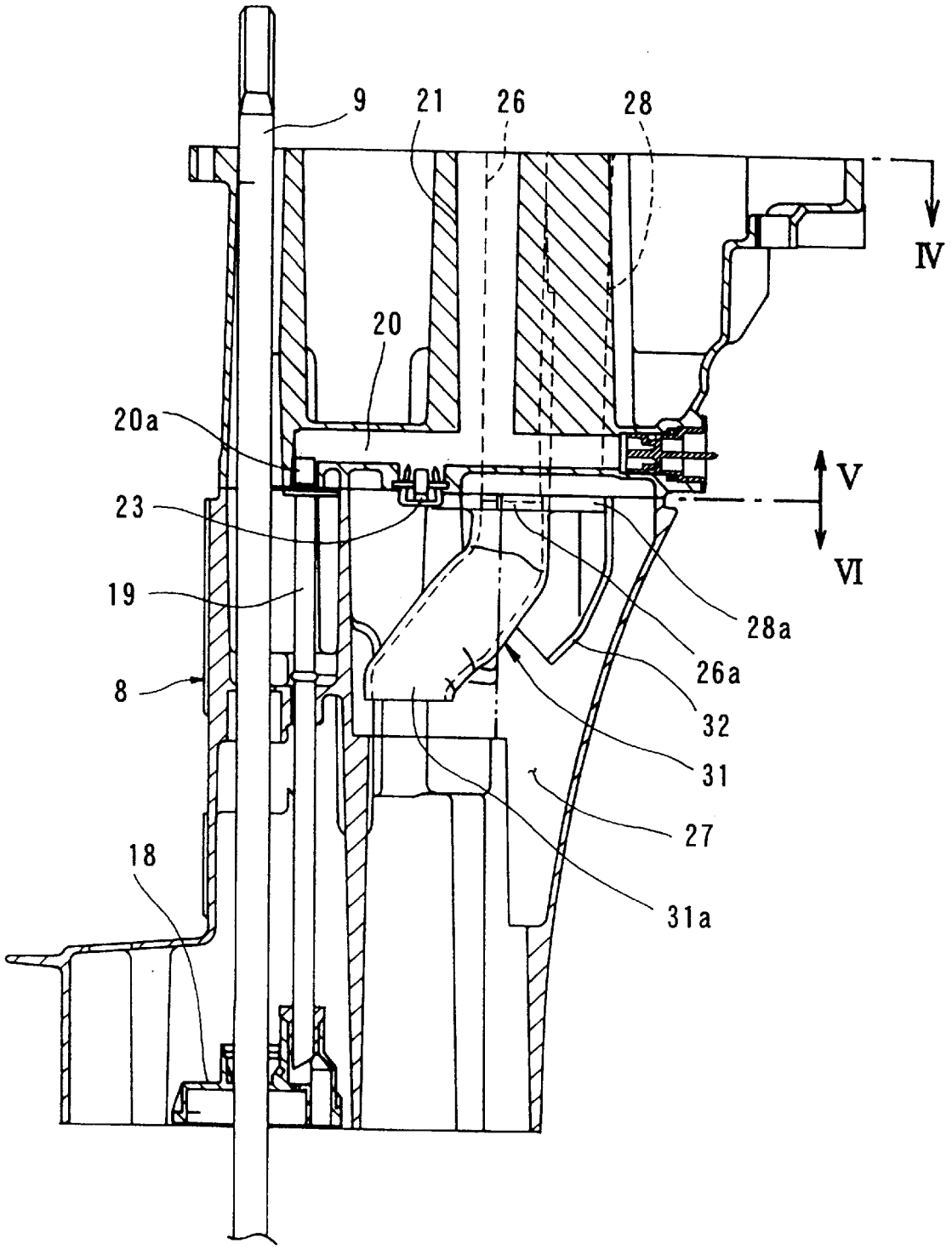
FIG. 3 is an enlarged sectional view of a central portion of the outboard motor.
Figure 5:
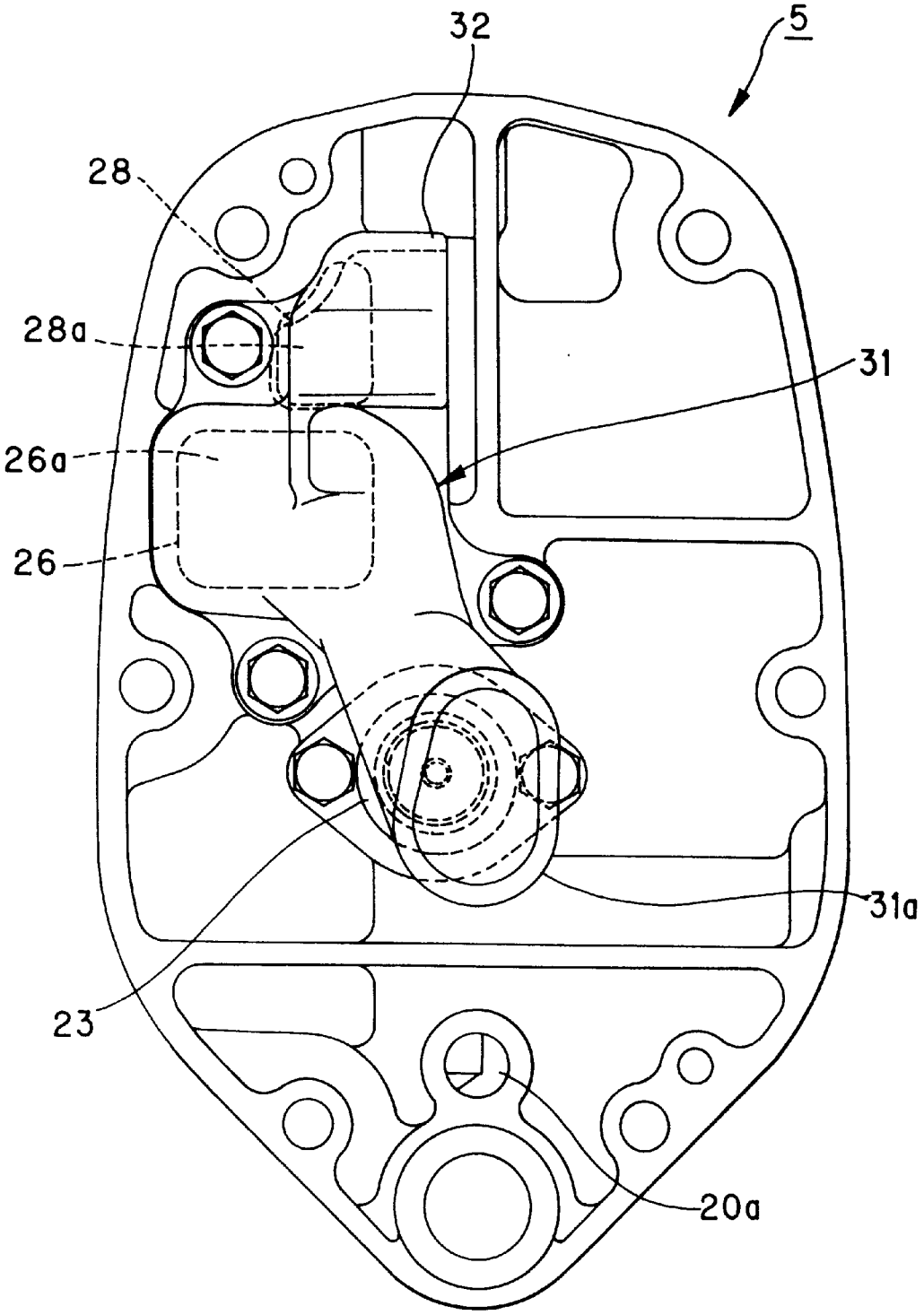
FIG. 5 is a view seen from a direction of an arrow V in FIG. 3 and shows a bottom portion of the oil pan of the outboard motor.

As shown in FIGS. 1, 3 and 5, the oil pan 5 is formed, at the bottom surface thereof, with the horizontal cooling water passage 20 extending horizontally. This horizontal cooling water passage 20 also extends in forward and backward direction at substantially the central portion of the bottom surface of the oil pan 5 and is provided, at its front end, with the cooling water intake port 20*a* opened towards the junction (mating) surface between the oil pan 5 and the drive shaft housing 8. The upper end portion of the feed-water pipe 19 is connected to the cooling water intake port 20*a*.

The vertical cooling water passage 21 is also formed so as to vertically extend from substantially the central portion of the horizontal cooling water passage 20 towards the mating portion (junction surface) of the oil pan 5 and the engine holder 2, and the upper end portion of the vertical cooling water passage 21 is connected to a cooling water passage 22 formed to the engine holder 2 as shown in FIG. 1. A thermostat valve, not shown, may be disposed on the downstream side of the cooling water passage 22 formed to the engine holder 2.

A water pressure valve 23 as a relief valve is mounted to the central lower portion of the horizontal cooling water passage 20 for releasing the cooling water in this passage 20, of which pressure has increased over a prescribed value, into a space formed in the drive shaft housing 8.

With reference to FIGS. 1 and 2, in the cylinder block 15 is formed a first exhaust passage 24 also acting as collection pipe connected to an exhaust port, not shown, formed in the cylinder head 14. A second exhaust passage 25 connected to the first exhaust passage 24 is also formed in the engine holder 2. Furthermore, a third exhaust passage 26 connected to the second exhaust passage 25 is formed in the oil pan 5.

This third exhaust passage 26 is disposed in a manner offset from the central portion of the oil pan 5 on the outer wall side thereof for making compact the oil pan 5 while ensuring a sufficient inner volume thereof. The downstream side end of the third exhaust passage 26 is opened to the space formed in the drive shaft housing 8, this space being utilized as an exhaust chamber 27.

A first cooling water passage, not shown, for cooling the first exhaust passage 24 is formed therearound. A further cooling water passage, not shown, for cooling the cylinder block 15 and the cylinder head 14, is also formed to the downstream portion of the first cooling water passage.

A second cooling water passage 22 for cooling the second exhaust passage 25 formed to the engine holder 2 is formed around the second exhaust passage 25. The second cooling water passage 22 is connected to the first cooling water passage.

Furthermore, a vertical cooling water passage 21, as a third cooling water passage, for cooling the third exhaust passage 26 formed to the oil pan 5 is formed around the third exhaust passage 26, and the downstream portion of the vertical cooling water passage 21 is connected to the second cooling water passage 22.

Figure 4:
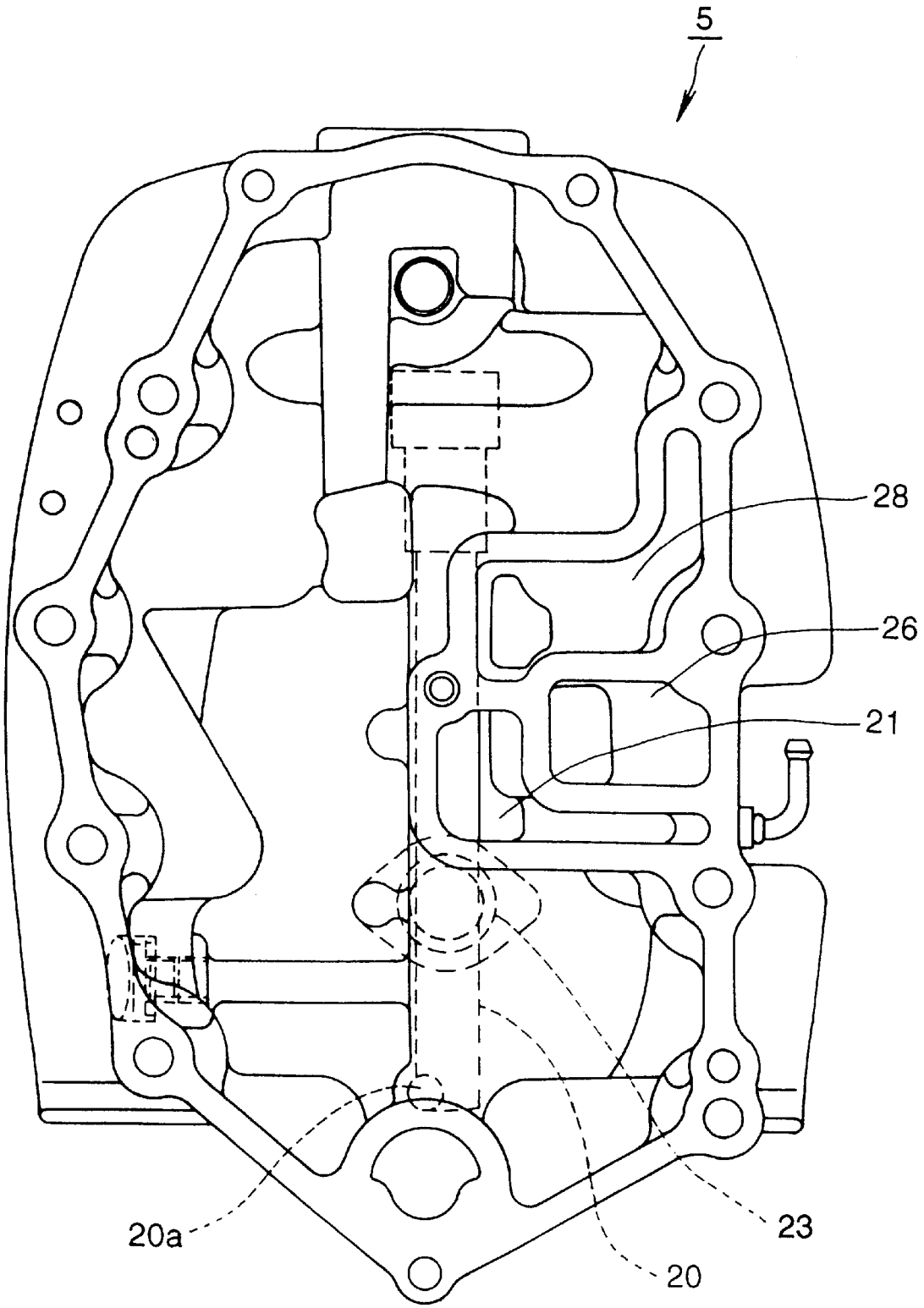
FIG. 4 is a view seen from a direction of an arrow IV in FIG. 3 and shows an upper portion of an oil pan of the outboard motor.

As shown in FIGS. 4 and 5, a cooling water discharge passage 28 is formed on one side of the third exhaust passage 26 so as to oppose to the vertical cooling water passage 21 which is disposed on the other side of the third exhaust passage 26, and another cooling water discharge passage 29 is also formed to the engine holder 2. The cooling water (return water) after cooling the parts of the engine 3 is guided from the upper portion of the cylinder head 14 to the cooling water discharge passage 29 through a discharge hose 30, as shown in FIG. 2, and then discharged towards the exhaust chamber 27 formed in the drive shaft housing 8 through the cooling water discharge passage 28 formed to the oil pan 5.

Figure 6:
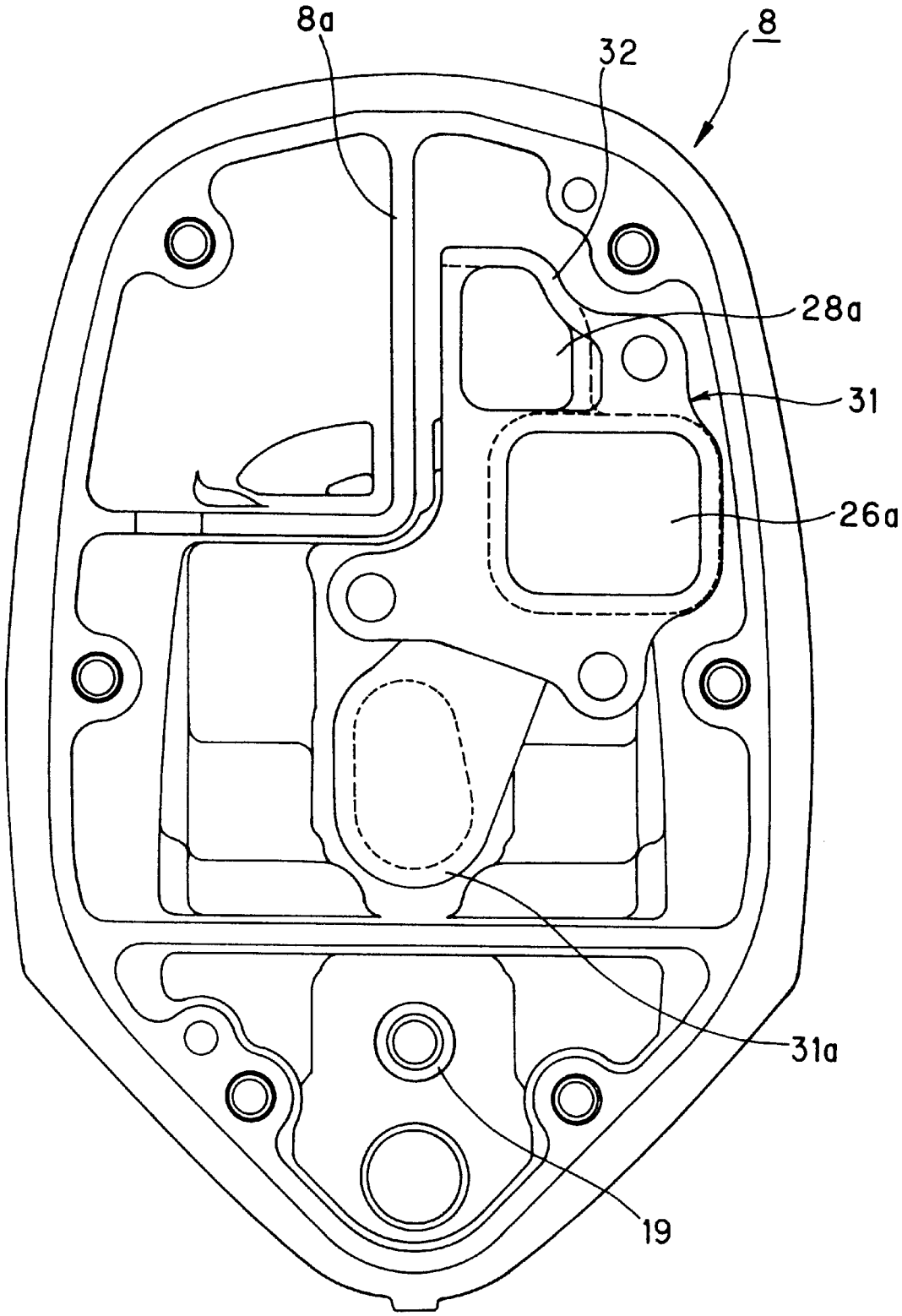
FIG. 6 is a view seen from a direction of an arrow VI in FIG. 3 and shows an upper portion of a drive shaft housing of the outboard motor.

As shown in FIGS. 3 and 5, an exhaust tube 31 is disposed to the bottom surface of the oil pan 5 so as to align with an downstream side end opening 26*a* of the third exhaust passage 26. This exhaust tube 31 is also shown in FIG. 6 for the purpose of making clear the positional relationship, and the exhaust tube 31 is not supported by the drive shaft housing 8 or contacted thereto.

As mentioned above, the exhaust tube 31 extends from the bottom surface of the oil pan 5 towards the exhaust chamber 27 disposed below the oil pan 5, and the exhaust tube 31 is bent so that the downstream side end opening 31*a* of the exhaust tube 31 is positioned to substantially the central portion, in a plan view, in the drive shaft housing 8 near the water pressure valve 23, that is, in this embodiment, substantially directly below the water pressure valve 23. The exhaust tube 31 may be preferably formed through a casting process.

Further, a return water guide 32 is provided for the bottom surface of the oil pan 5 so as to align with the downstream side end opening 28*a* of the cooling water discharge passage 28. The return water guide 32 has a box-shaped section having an opened side and is formed integrally with the exhaust tube 31. The opened side of the box-shaped return water guide 32 is disposed so as to face a vertical wall section 8*a* formed in the drive shaft housing 8. This return water guide 32 is disposed on one side of the exhaust tube 31 so as to oppose to the water pressure valve 23 which is disposed on the other side of the exhaust tube 31.

The functions and effects of the present invention will be described hereunder.

The flows of the exhaust gas discharged from the respective cylinders in accordance with the engine operation are combined in the first exhaust passage 24 and the combined exhaust gas is guided to the second exhaust passage 25 formed in the engine holder 2 and then to the third exhaust passage 26 formed in the oil pan 5, and thereafter, the exhaust gas is discharged into the exhaust chamber 27 formed in the drive shaft housing 8.

According to the present invention, the exhaust gas is guided to substantially the central portion of the drive shaft housing 8, in a plan view, by means of the exhaust tube 31 provided for the bottom surface of the oil pan 5. Therefore, the exhaust gas having a high temperature does not directly collide with the outer wall section of the drive shaft housing 8, and accordingly, the temperature increasing of the outer wall section can be prevented and the adhesion of calcium, which may be contained in sea water, for example, to the outer wall section of the drive shaft housing 8 can be also prevented.

Incidentally, when the drive shaft 9 is rotated through the operation of the engine 3, the cooling water is pumped up by means of water pump 18, and the pumped-up water is guided, through the cooling water intake port 20*a*, to the horizontal cooling water passage 20 and the vertical cooling water passage 21 formed in the oil pan 5. The cooling water is then guided to the respective portions or parts of the engine 3 through the second cooling water passage 22 formed to the engine holder 2. Thereafter, the cooling water after cooling the respective portions of the engine 3 is discharged, as the return water, into the exhaust chamber 27 through the cooling water discharge passages 28 and 29.

According to the present invention, the return water, which is discharged in the exhaust chamber 27, is guided to substantially the central portion of the drive shaft housing 8, in a plan view, by means of the return water guide 32 integrally formed with the exhaust tube 31 provided for the bottom surface of the oil pan 5. Therefore, the return water having a high temperature does not directly collide with the outer wall section of the drive shaft housing 8, and accordingly, the temperature increasing of the outer wall section can be prevented and the adhesion of calcium, which may be contained in sea water, for example, to the outer wall section of the drive shaft housing 8 can be also prevented.

Further, when the cooling water has a low temperature at a time just after the starting operation of the engine 3, a thermostat valve, not shown, disposed downstream side of the second cooling water passage 22 in the engine holder 2 is operated so as to interrupt the cooling water flow to thereby warm up the engine.

During the warm-up operation, the water pump 18 is driven though the cooling water flow is interrupted, and during this operation, although the cooling water pressure at the upstream side of the thermostat valve increases, a portion of the cooling water of which pressure excessively increases is discharged because of the location of the water pressure valve 23 to the horizontal cooling water passage 20 on the upstream side of the thermostat valve. Since the water pressure valve 23 is disposed to the lower portion of the horizontal cooling water passage 20 so as to be directed downward, the cooling water can be discharged towards the exhaust chamber 27 formed in the drive shaft housing 8.

Furthermore, according to the present invention, the exhaust tube 31 is formed so as to extend from the bottom surface of the oil pan 5 towards the exhaust chamber 27 disposed below the oil pan 5, and the exhaust tube 31 is bent so that the downstream side end opening 31*a* of the exhaust tube 31 is positioned to substantially the central portion, in a plan view, in the drive shaft housing 8 near the water pressure valve 23, that is, in this embodiment, substantially directly below the water pressure valve 23. Therefore, the cooling water having a low temperature pumped up by the water pump 18 is directly jetted to the exhaust tube 31 to thereby cool the exhaust tube 31 and the exhaust gas filling the inside thereof and, hence, to prevent the temperature in the exhaust chamber 27 from rising. The cooling water discharged in the exhaust chamber 27 by the water pressure valve 23 is dispersed in the exhaust chamber 27 to thereby reduce the temperature therein.

Still furthermore, the return water guide 32 provided for the bottom surface of the oil pan 5 so as to provide the box-shaped section is arranged so as to face the vertical wall section 8*a* formed in the drive shaft housing 8, thus providing a closed sectional structure. Accordingly, the cross sectional area, i.e. effective passage area, of the cooling water discharge passages 28 and 29 through which the cooling water passes can be ensured to be large.

Still furthermore, since the return water guide 32 formed integrally with the exhaust tube 31 is formed so as to have a box-shape section, it is not necessary to use a core in the casting process, thus being advantageous in economical point and structural point and improving the yielding.

According to the present invention, furthermore, since the return water guide 32 and the exhaust tube 31 are formed integrally, the return water having a temperature lower than that of the exhaust gas can be utilized as the cooling water for the exhaust tube 31. Moreover, the return water guide 32 is disposed on one side of the exhaust tube 31 so as to oppose to the water pressure valve 23 which is disposed on the other side of the exhaust tube 31, so that the portion of the exhaust tube 31 which has not been cooled by the cooling water discharged from the water pressure valve 23 can be cooled by the return water, thus improving the cooling efficiency of the exhaust tube and the exhaust gas.

Further, it is to be noted that the present invention is not limited to the described embodiment and many other changes and modifications may be made without departing from the scopes of the appended claims.

For example, it is of course possible to applied the present invention to a two-stroke-cycle engine, while the above present invention is applied to the four-stroke-cycle engine.

What is claimed is:

1. An outboard motor comprising:

an engine holder;

an engine disposed above the engine holder in a state of the outboard motor being mounted to a hull;

an oil pan disposed below the engine holder;

a drive shaft housing disposed below the oil pan;

an exhaust passage means formed in the engine, the engine holder and the oil pan and adapted to exhaust an exhaust gas from the engine into the drive shaft housing, said exhaust passage means having a downstream side end opening;

an exhaust tube provided for a bottom surface portion of the oil pan so as to align with the downstream side end opening of the exhaust passage means, said exhaust tube having a downstream side outlet positioned, in a plan view, at a substantially central portion of the drive shaft housing;

a water pump disposed at a bottom portion of the drive shaft housing for pumping up a cooling water; and a cooling water passage means formed in the engine holder and the oil pan, wherein the cooling water pumped up by the water pump is guided to the engine through the cooling water passage means, said cooling water passage means includes a passage formed in the oil pan, a relief valve is provided for said passage portion directly above the downstream side outlet of the exhaust tube, said relief valve having a structure for relieving an excess pressure of the cooling water before the cooling of the engine, said exhaust tube is disposed in a vicinity of the relief valve, and a return water guide is arranged along the exhaust tube.

2. An outboard motor according to claim 1, wherein said cooling water passage means comprises a plurality of cooling water passages including a horizontal passage portion formed to a bottom portion of the oil pan for which said relief valve is provided.

3. An outboard motor according to claim 1, further comprising a cooling water discharge passage means formed in the engine holder and the oil pan for discharging the cooling water after cooling the engine inside the drive shaft housing and a return water guide formed integrally with said exhaust tube, said cooling water discharge passage means having a downstream side end opening with which said return water guide is aligned.

4. An outboard motor according to claim 3, wherein said cooling water discharge passage means comprises a plurality of cooling water discharge passages including a passage formed to the oil pan which has the downstream side end opening with which said return water guide is aligned.

5. An outboard motor according to claim 1, wherein said return water guide is disposed on one side of the exhaust tube and said relief valve is disposed on another one side of the exhaust tube.

6. An outboard motor comprising:

an engine holder;

an engine disposed above the engine holder in a state of the outboard motor being mounted to a hull;

an oil pan disposed below the engine holder;

a drive shaft housing disposed below the oil pan;

an exhaust passage means formed in the engine, the engine holder and the oil pan and adapted to exhaust an exhaust gas from the engine into the drive shaft housing, said exhaust passage means having a downstream side end opening;

an exhaust tube provided for a bottom surface portion of the oil pan so as to align with the downstream side end opening of the exhaust passage means, said exhaust tube having a downstream side outlet positioned, in a plan view, at a substantially central portion of the drive shaft housing;

a water pump disposed at a bottom portion of the drive shaft housing for pumping up a cooling water;

a cooling water passage means formed in the engine holder and the oil pan; and a cooling water discharge passage means formed in the engine holder and the oil pan for discharging the cooling water after cooling the engine inside the drive shaft housing, wherein the cooling water pumped up by the water pump is guided to the engine through the cooling water passage means, said cooling water passage means includes a passage portion formed in the oil pan, a relief valve is provided for said passage portion directly above the downstream side outlet of the exhaust tube, said relief valve having a structure for relieving an excess pressure of the cooling water before the cooling of the engine, said exhaust tube is disposed in a vicinity of the relief valve, and a return water guide is further arranged integrally with the exhaust tube, said cooling water discharge passage means having a downstream side end opening with which said return water guide is aligned, and said return water guide has a box-shaped cross section having an opened side portion which is disposed so as to face a vertical wall section formed in the drive shaft housing.

* * * * *